US005704417A

United States Patent [19]

Christensen et al.

[11] Patent Number: 5,704,417

[45] Date of Patent: Jan. 6, 1998

[54] PERFORATED FIN HEAT AND MASS TRANSFER DEVICE

[75] Inventors: Richard N. Christensen, Columbus, Ohio; Srinivas Garimella, Kalamazoo, Mich.; Yong Tae Kang, Columbus; Michael Garrabrant, Johnstown, both of Ohio

[73] Assignee: Gas Research Institute, Chicago, Ill.

[21] Appl. No.: 697,716

[22] Filed: Aug. 23, 1996

[51] Int. Cl.[6] ..... B01F 3/04

[52] U.S. Cl. ..... 165/110; 165/907; 165/183; 165/164; 261/112.2; 261/113; 261/140.2; 261/156

[58] Field of Search ..... 165/181, 183, 165/164, 109.1, 907, 916, 110; 62/484, 485; 261/112.2, 113, 140.2, 156

[56] References Cited

U.S. PATENT DOCUMENTS

| | | | |
|---|---|---|---|
| 1,247,917 | 11/1917 | Wentworth et al. . | |
| 1,426,235 | 8/1922 | Wentworth . | |
| 2,002,923 | 5/1935 | Palmer | 257/130 |
| 2,006,649 | 7/1935 | Modine | 257/130 |
| 2,119,761 | 6/1938 | Wentworth | 257/255 |
| 2,653,800 | 9/1953 | Anton | 257/261 |
| 2,789,797 | 4/1957 | Simpelaar | 257/245 |
| 3,003,749 | 10/1961 | Morse | 257/130 |
| 3,265,127 | 8/1966 | Nickol et al. | 165/152 |
| 3,380,518 | 4/1968 | Canteloube et al. | 165/171 |
| 3,438,433 | 4/1969 | Gunter | 165/151 |
| 4,328,861 | 5/1982 | Cheong et al. | 165/151 |
| 4,693,307 | 9/1987 | Scarselletta | 165/152 |

*Primary Examiner*—Allen J. Flanigan

*Attorney, Agent, or Firm*—McAndrews, Held & Malloy, Ltd.

[57] ABSTRACT

A fluid heat exchange apparatus is disclosed that can be used as an absorber in an absorption cooling system. The compact absorber design uses an accordion fin assembly to direct solution downward through the absorber on a plurality of alternatively angled fins. The alternatively angled fins cause the solution to collect at each level against a thermally conductive surface. Each fin includes a plurality of house-shaped perforations that allow the solution to spill over onto the next level fin. The house-shaped perforations also allow the vapor to flow upward in effective counterflow with the solution.

3 Claims, 4 Drawing Sheets

PERFORATED FIN HEAT AND MASS TRANSFER DEVICE

FIELD OF THE INVENTION

The present invention relates to a fluid heat exchange apparatus, in particular an absorber for use in an absorption cooling system.

BACKGROUND OF THE INVENTION

Absorption cooling systems are well known. In an absorption cooling system, a generator heats a refrigerant solution comprising a "strong" or concentrated solution of a more volatile or refrigerant component in a less volatile or solvent component. The heat drives the refrigerant from the strong solution to separate a refrigerant vapor, leaving a "weak" solution that is depleted of the refrigerant.

Typically, the refrigerant is ammonia. The ammonia is dissolved in water to create an ammonia solution. Alternatively, the refrigerant may be water vapor that is driven from a lithium bromide solution. In the case of an ammonia solution, as will be described in this specification, the weak solution has a low concentration of ammonia and the strong solution has a higher concentration of ammonia.

After being separated in the generator, the refrigerant vapor leaves the generator, flowing to a condenser. In the condenser the refrigerant vapor is placed under pressure and heat is removed to an external heat sink. As a result, the vapor condenses to form a refrigerant liquid. After leaving the condenser, the refrigerant liquid flows to an evaporator. The evaporator relieves the pressure on the refrigerant liquid and the refrigerant evaporates, again forming a vapor. This evaporation of the refrigerant draws heat from a heat load and creates the cooling effect of a refrigerator, air conditioner, or cooling system.

The refrigerant vapor from the evaporator flows to an absorber. The weak solution remaining in the generator also flows to the absorber. In the absorber, the weak solution reabsorbs the refrigerant, reforming the strong solution.

In most absorbers, the weak solution enters the top of the enclosed absorber and flows downward. The refrigerant enters the bottom of the absorber and flows upward. In counterflow with the refrigerant vapor, the weak solution absorbs the refrigerant and becomes a strong solution. The strong solution then flows out of the absorber, back to the generator, and the cycle repeats.

Having been heated to drive off refrigerant vapor in the generator, the weak solution is very hot. Also, he absorption process further heats the solution as the solution becomes stronger. More refrigerant can be absorbed in the solution if the solution is cooled. Therefore, to facilitate absorption of the refrigerant into the solution, the solution must be cooled.

A coolant circulates through the absorber in a thermally conductive conduit and draws heat from the solution and the refrigerant vapor. The conduit prevents intermixing of the liquid coolant and the refrigerant solution. The solution, however, transfers heat through the walls of the conduit and into the coolant. To improve efficiency, the absorber must promote heat transfer from the refrigerant solution and vapor to the coolant. Heat transfer is promoted by maximizing contact of the refrigerant solution and vapor with a heat transfer surface. Further, to promote absorption of the vapor into solution, the vapor must be placed in effective counterflow with the solution. Absorption is promoted by maximizing contact of the upward vapor flow with the downward solution flow.

In the prior art, many absorbers circulate the coolant in metal pipe or tubing. Metal pipe provides a simple method for circulating a coolant in an absorber. The refrigerant solution flows or is sprayed over the cooler surface of the pipe or, alternatively, the coolant pipe is submerged in a pool of solution. This prior absorber design increases heat transfer by increasing the length of pipe in the absorber.

Coolant pipe, however, has several disadvantages. First, metal pipe is expensive and a large amount is needed in an absorber. Also, metal pipe must be formed into complex and intricate convoluted shapes that are difficult and expensive to manufacture. Second, pipe inefficiently transfers heat from the refrigerant solution to the enclosed coolant. For efficient heat transfer, the metal pipe can be completely submerged in a pool of solution. Then, however, only the surface of the solution contacts the refrigerant vapor. The coolest portion of the solution under the surface does not contact the refrigerant vapor.

Ideally, the refrigerant solution simultaneously contacts both the coolant conduit and the refrigerant vapor. While the solution is cooled, the solution may simultaneously absorb refrigerant. Older absorber designs recognize the benefit of simultaneous contact. In these designs, the refrigerant solution meanders over coolant baffles within a vapor space or flows through a series of pools. Alternatively, the solution is sprayed or dripped through a vapor space onto coolant pipe. These designs, however, require a large amount of space to enclose the vapor. Reduced size has become one of the greatest challenges of absorber design. If absorber size can be reduced, absorption cooling systems will find more widespread application.

Accordingly, those skilled in the art of absorber design have sought an absorber that fully saturates a solution, uses a coolant efficiently, is simple and inexpensive to manufacture, and is compact in size.

Therefore, an object of the present invention is to provide a heat exchange device that maximizes heat transfer between two fluids.

Also, an object of the present invention is to provide an absorber that maximizes contact between a refrigerant solution and a refrigerant vapor so that the solution becomes fully or nearly fully saturated with refrigerant vapor.

A further object of the present invention is to provide an absorber that maximizes the cooling potential of a coolant passing through an absorber.

Another object of the present invention is to provide an absorber that is compact in size.

Finally, an object of the present invention is to provide an absorber that is simple and economical to manufacture.

SUMMARY OF THE INVENTION

One aspect of the present invention is an apparatus that can be used for transferring heat from a fluid, dissolving a vapor into the fluid, or both. The apparatus includes a substantially vertical surface separating a first fluid space and a second fluid space. The substantially vertical surface is thermally conductive to allow heat transfer between the first fluid space and the second fluid space. The first fluid space contains a downward flowing solution and, in the case of an absorber, an upward flowing vapor. The second fluid space contains a solution.

A plurality of angled fins are located in the first fluid space. The edges of the fins are located adjacent the substantially vertical surface and the fins angle upward from edges to create a solution pool adjacent the substantially vertical surface. Each angled fin has a plurality of house-shaped perforations to allow solution to flow of downward through the angled fins.

The drawings are not necessarily to scale and particular embodiments are sometimes illustrated by graphic symbols, diagrammatic representations, and fragmentary views. Details unnecessary for an understanding of the present invention may have been omitted. The invention is not limited to the particular embodiments illustrated herein.

DETAILED DESCRIPTION OF THE INVENTION

Although the invention is described in connection with one or more preferred embodiments, the invention is not limited to those embodiments. The invention includes alternatives, modifications, and equivalents that are included in the spirit and scope of the appended claims.

Figure 1:
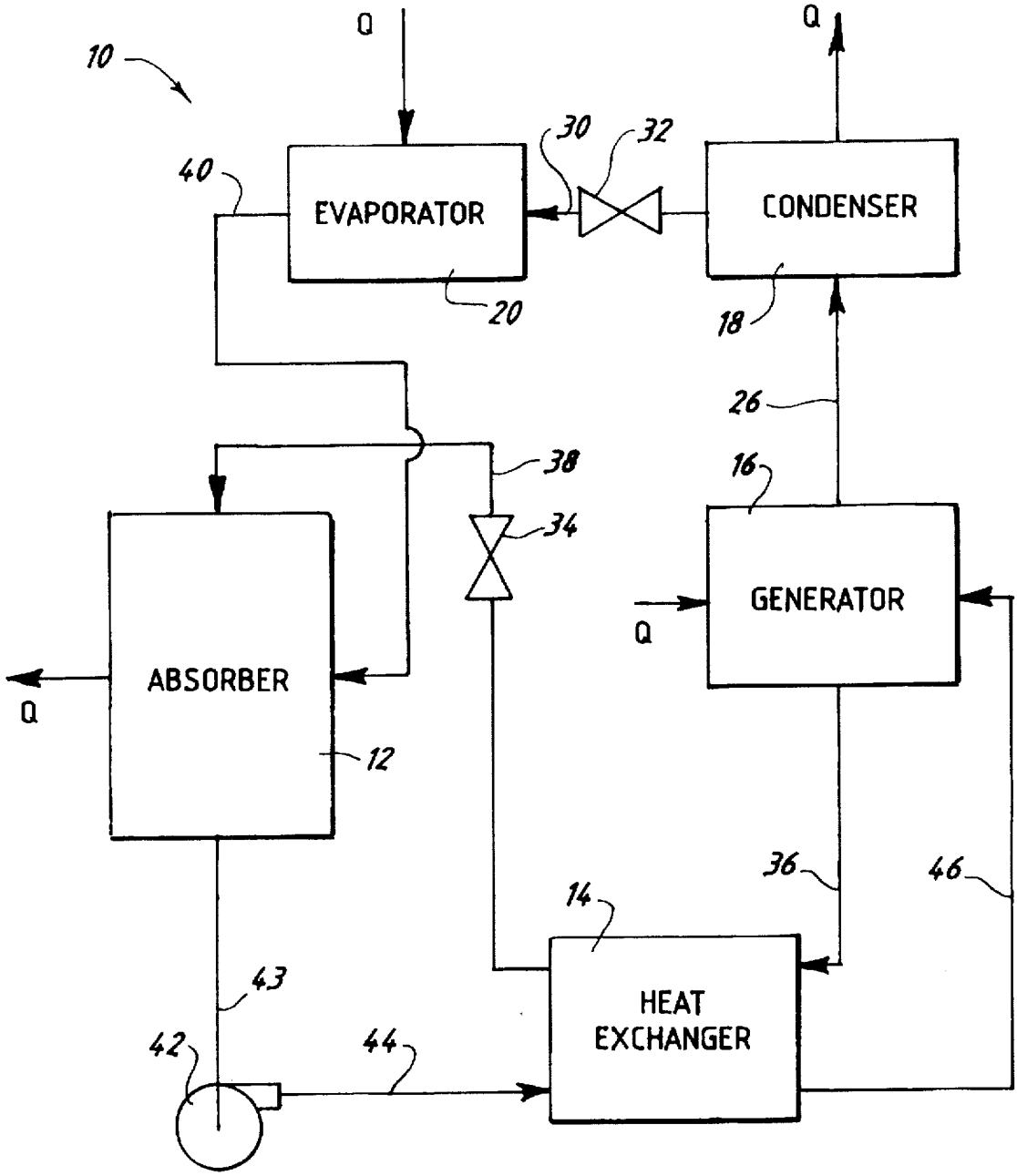
FIG. 1 is a schematic flow diagram of a typical absorption cooling system.

As seen in FIG. 1, one embodiment of the present invention operates in a single stage absorption cooling system 10. The absorption cooling system 10 includes a generator 16, a condenser 18, an evaporator 20, an absorber 12, and a heat exchanger 14.

When it enters the generator 16, the strong refrigerant solution generally has its maximum concentration of dissolved refrigerant vapor. The refrigerant solution is heated in the generator 16, as represented by the letter Q and the arrow indicating the direction of heat transfer. The heat distills the refrigerant from the solution to form a free refrigerant vapor. The remaining liquid is now a "weak solution." The refrigerant vapor leaves the generator 16 via he conduit 26 and flows to a condenser 18.

In the condenser 18, the refrigerant vapor is maintained under pressure and allowed to cool. As a result, the refrigerant vapor condenses to become a liquid. The heat of condensation Q is removed to a heat sink. The liquid refrigerant then flows to the evaporator 20 via the conduit 30. As the liquid refrigerant flows to the evaporator 20, the first expansion valve 32 relieves the pressure on the refrigerant. The refrigerant evaporates in the evaporator 20, absorbing heat Q into the system from a heat load to produce the cooling effect of the present system.

After the generator 16 drives the refrigerant from the strong solution, the weak solution remains. The weak solution is hot, having been heated to evaporate and separate the refrigerant vapor. The weak solution flows to the heat exchanger 14 via a conduit 36. In the heat exchanger 14, the weak solution transfers heat to the cooler strong solution flowing to the generator 16.

The weak solution then flows to the absorber 12 via the conduit 38. A second expansion valve 34 regulates the pressure of the flow of the weak solution to the absorber 12. The refrigerant vapor also flows to the absorber 12 from the evaporator 20 via the conduit 40. In the absorber 12, the refrigerant vapor is reabsorbed into the solution.

After reabsorption, the resulting strong solution is pumped by the strong solution pump 42 to the heat exchanger 14 via the conduits 43 and 44. As previously described, the strong solution flows in heat exchange relationship with the hotter weak solution in the heat exchanger 14. The strong solution then flows back to the generator via the conduit 46. The process continuously repeats as long as the system is in operation.

The absorption process in the absorber 12 generates heat that must be removed to facilitate reabsorption of the refrigerant into the solution. To transfer this heat, a heat transfer fluid, such as a liquid coolant, is circulated through the absorber 12 in heat exchange relationship with the refrigerant solution and vapor. After circulating through the absorber 12, the liquid coolant exits the absorber 12 and is either disposed or recycled through the system after cooling.

Figure 2:
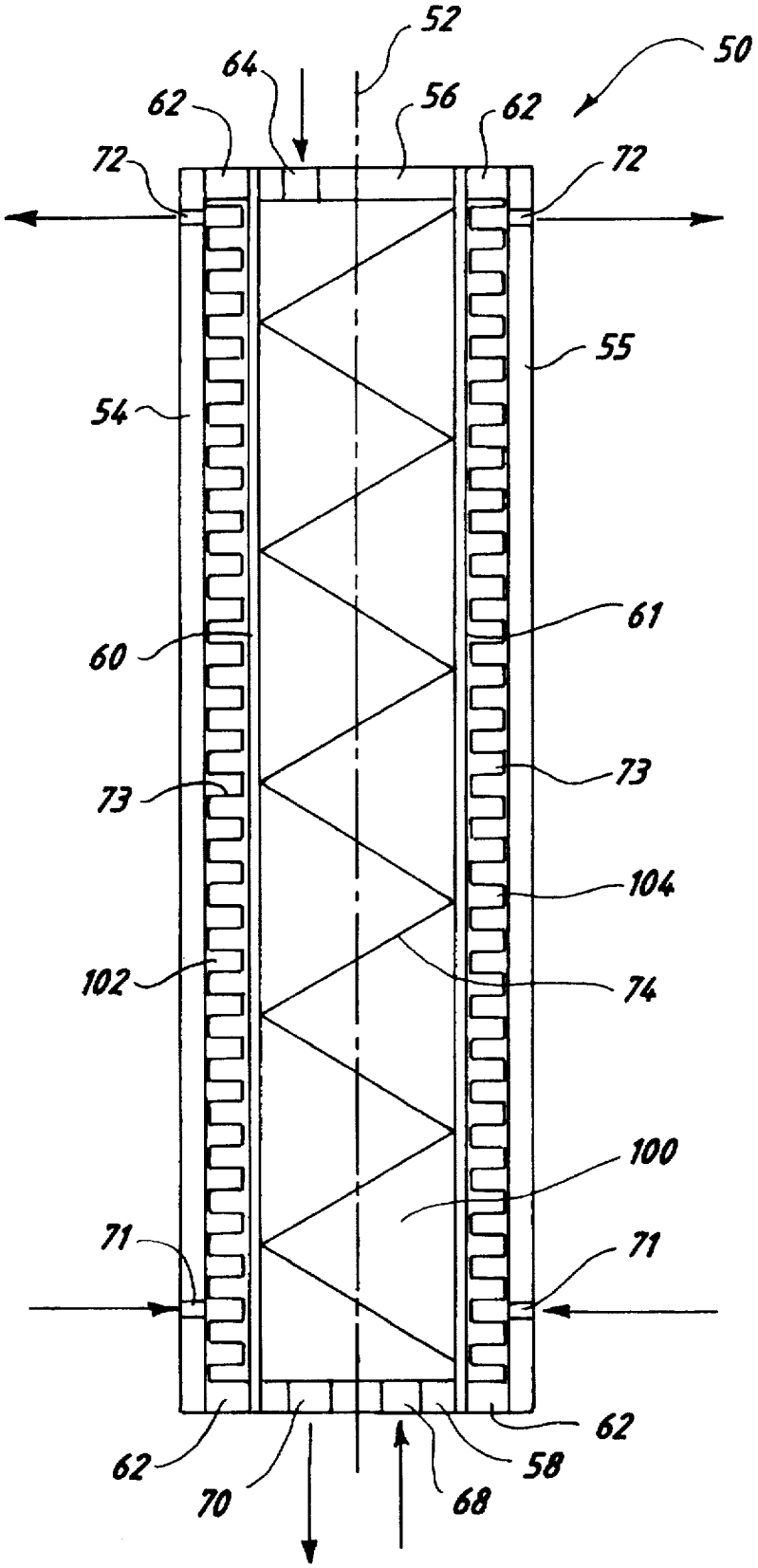
FIG. 2 is a cross sectional view of a heat exchange cell.

FIG. 2 is a cross section of a cell 50 according to the present invention. As will be described in terms of a preferred embodiment, the cell 50 operates as an absorber. However, as will be described, the present invention may also be operated as a generator or a simple heat exchanger.

The cell 50 is oriented about a normally substantially vertical axis 52. The cell 50 includes outer housing plates 54 and 55, an upper plate 56, a lower plate 58, inner housing plates 60 and 61, coolant space seals 62, a weak solution inlet 64, a vapor inlet 68, a strong solution outlet 70, coolant inlets 71, coolant outlets 72, coolant baffles 73, and an accordion fin assembly 74. The accordion fin assembly includes a plurality of fins 75.

Refrigerant vapor from the evaporator 20 enters bottom of the absorber cell 50 at the vapor inlet 68. Weak solution from the heat exchanger 14 enters the top of the absorber cell 50 at the weak solution inlet 64. As will be described more fully, the vapor flows upward through the solution space 100 and the weak solution flows downward by the force of gravity through the solution space 100. In counterflow, the vapor is absorbed into the weak solution to create a strong solution. The strong solution exits the absorber at the strong solution outlet 70.

Liquid coolant enters the bottom of the absorber at the coolant inlets 71 and is pumped upward over the coolant baffles 73 in the coolant spaces 102 and 104. The liquid coolant exits the coolant spaces 102 and 104 at the coolant outlets 72. Because the inner housing plates 60 and 61 are thermally conductive, the heat of absorption from the solution and vapor is transferred to the coolant, cooling the solution and vapor and providing for more effective absorption.

Figure 3A:
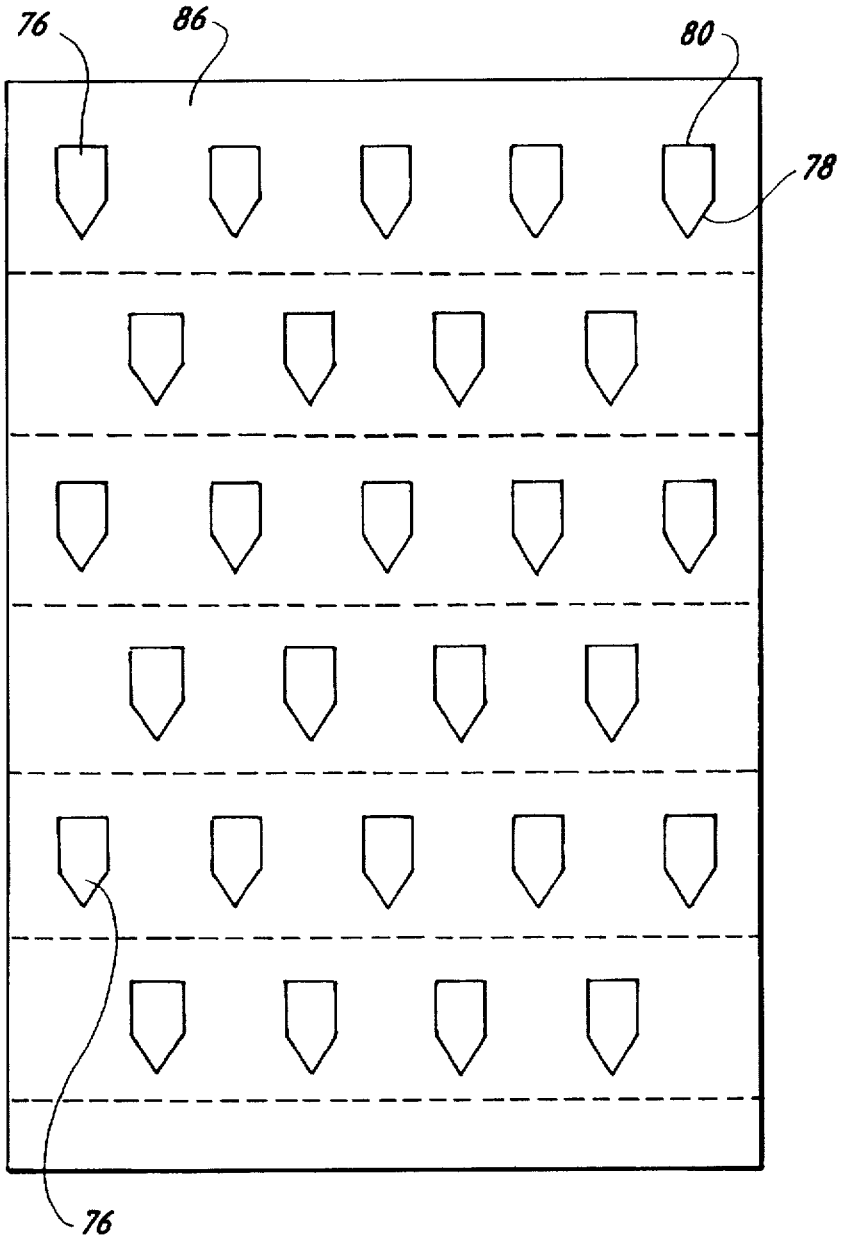
FIGS. 3*a* and 3*b* are views showing the construction of the accordion fin assembly used in the present invention.
Figure 3B:
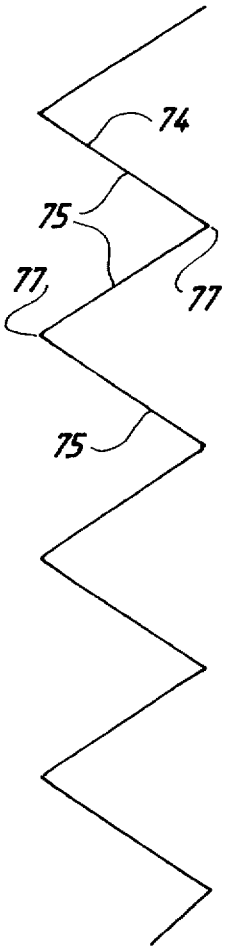

To promote heat exchange with the coolant and promote absorption of the vapor into solution, the solution space includes the accordion fin assembly 75. In the preferred embodiment, the accordion fin assembly is constructed as shown in FIGS. 3*a* and 3*b*. The sheet 60 is comprised of a thermally conductive material such as steel. The sheet 60 is stamped with house-shaped perforations 76. Each house-shaped perforation 76 has a triangular end 78 and a rectangular end 80. After stamping, the sheet 86 is formed into an accordion shape as shown in FIG. 3*b*. The accordion fin assembly 74 is placed in the solution space 100 so that the edges 77 of each fin are substantially adjacent the inner housing plates 60 and 61. The edges 77 of each fin may also be welded or brazed to the inner housing plates 60 and 61.

Figure 4:
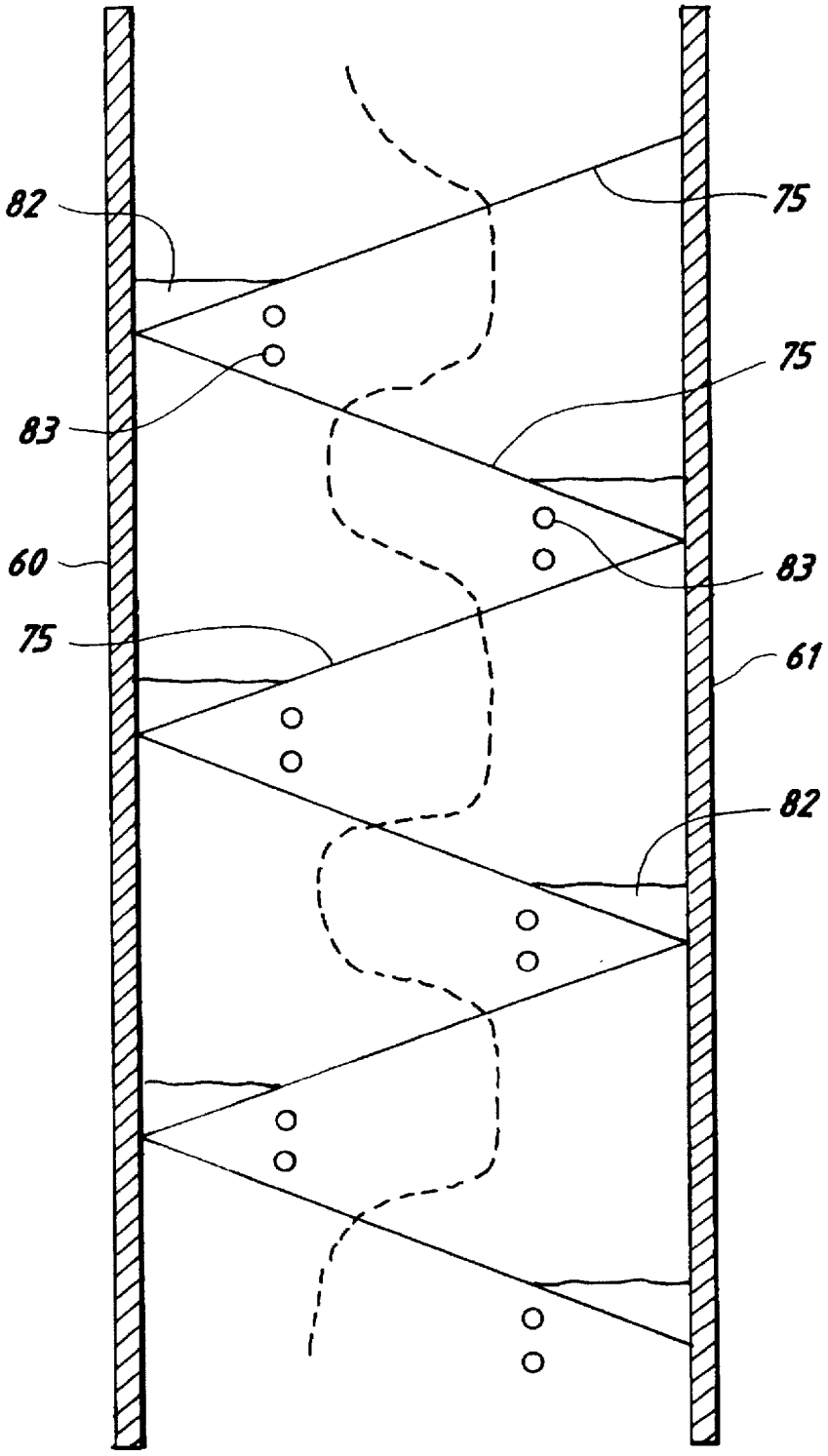
FIG. 4 is a cross sectional view of an absorber cell that illustrates the fluid flow within the cell.

With the accordion fin assembly 74 in place, the flow of the solution and vapor is affected as shown in FIG. 4. Flowing downward, the solution collects in pools 82 where the edges 77 of the fins 75 meet the inner housing plates 60 and 61. When the solution pool 82 reaches a level determined by the position of the house-shaped perforations 76

(shown in FIG. 3), the solution drips 83 onto the fin 75 at the next level below. The solution then runs down the next fin and collects in another solution pool.

Because the triangular ends 78 of the house-shaped perforations 76 point towards the solution pools 82, a metered flow of solution is created. When running at a steady state, the solution will flow at a continuous rate through the tip of the triangular end 78 of a house-shaped perforation 76. However, if the rate of solution input increases, the solution may flow through the rectangular ends 80 of the house-shaped perforations. This feature helps to prevent flooding within the absorber cell and promotes an equal flow of solution through the cell.

The rectangular ends 80 of the house-shaped perforations 76 enable the vapor to freely flow upward through the fins 75. However, because the perforations are offset at each level of fins 75, as shown in FIGS. 3 and 4, the vapor must follow a meandering path upward through the cell 50. The meandering path forces the vapor into contact with solution throughout the cell. The increased contact of vapor and solution promotes absorption.

Further, the solution path promotes absorption. The solution flows through each perforation 76 in intimate contact with the upward flowing vapor. Also, by dripping from level to level, the surface area of solution in contact with the vapor is increased. In addition, the dripping of the solution creates a thin film of solution on each fin 75. Like the inner housing plates 60 and 61, the fins 75 are preferably thermally conductive and conduct the heat of the solution film to the coolant in the coolant spaces 102 and 104.

The cell 50 may be used as a stand alone absorber. Alternatively, if a heating fluid is provided instead of a cooling fluid and a strong solution is fed to the cell 50, the unit may be operated as a generator. The heat of the fluid may be used to drive vapor from the strong solution under similar operating principles as described for the preferred embodiment. As a still further alternative, the construction of the present invention and the house-shaped perforations may be used to simply exchange heat between fluids.

Also, the cell 50 may be used in conjunction with other cells. Rather than a single solution space and two coolant spaces, multiple solution spaces may be alternated with coolant spaces to increase the load potential of the absorber.

The present invention offers many advantages. First, the present invention provides effective absorption in a compact package. In addition, the absorber is relatively easy and inexpensive to manufacture. The processes of stamping and forming a metal sheet are well known. Also, by modifying the size of the perforations and/or the distance and angle between each level of fins, the performance of absorber may be changed, modified, and optimized. Thus, the present invention provides a novel, efficient, inexpensive, and versatile absorber design.

The present invention is not limited to the precise form of apparatus disclosed. One skilled in the art may easily and readily adapt the teachings of the present invention to any device with two fluids flowing in heat exchange relationship. Many alterations, variations, and combinations are possible that fall within the scope of the present invention. Although the preferred embodiments of the present invention have been described, those skilled in the art will recognize other modifications that would nonetheless fall within the scope of the present invention. Therefore, the present invention should not be limited to the apparatus described. Instead, the scope of the present invention should be consistent with the invention claimed below.

We claim:

1. A fluid heat exchange device comprising:

a substantially vertical surface separating a first fluid space and a second fluid space, the substantially vertical surface being thermally conductive to allow heat transfer between the first fluid space and the second fluid space;

the first fluid space containing a downward flowing fluid;

the second fluid space containing a second fluid;

an angled fin in the first fluid space, the angled fin having a first edge adjacent the substantially vertical surface, the angled fin angling upward from the first edge to create a downward flowing fluid collection space adjacent the substantially vertical surface;

the angled fin having a house-shaped perforation to allow a flow of downward flowing fluid through the angled fin.

2. The fluid heat exchange device of claim 1, wherein the first fluid space also contains an upward flowing vapor, the house-shaped perforation allowing the vapor to flow upward through the angled fin.

3. The fluid heat exchange device of claim 2, wherein the house-shaped perforation is comprised of a triangular end and a rectangular end, the triangular end positioned downward of the rectangular end on the angled fin to allow a metered flow of downward flowing fluid through the angled fin.

* * * * *